US008845370B2

(12) United States Patent
Roodenburg et al.

(10) Patent No.: US 8,845,370 B2
(45) Date of Patent: Sep. 30, 2014

(54) VESSEL WITH A RETRACTABLE THRUSTER ASSEMBLY

(75) Inventors: Joop Roodenburg, Delft (NL); Pieter Dirk Melis van Duivendijk, Missoury City, TX (US)

(73) Assignee: ITREC B.V., Schiedam (NL)

( * ) Notice: Subject to any disclaimer, the term of this patent is extended or adjusted under 35 U.S.C. 154(b) by 260 days.

(21) Appl. No.: 13/395,853

(22) PCT Filed: Sep. 14, 2010

(86) PCT No.: PCT/NL2010/050588

§ 371 (c)(1),
(2), (4) Date: May 25, 2012

(87) PCT Pub. No.: WO2011/031158

PCT Pub. Date: Mar. 17, 2011

(65) Prior Publication Data

US 2012/0231682 A1 Sep. 13, 2012

(30) Foreign Application Priority Data

Sep. 14, 2009 (NL) ..... 1037281

(51) Int. Cl.
*B63H 5/125* (2006.01)

(52) U.S. Cl.
CPC ..... *B63H 5/125* (2013.01)
USPC ..... 440/54

(58) Field of Classification Search
USPC ..... 440/54, 6
See application file for complete search history.

(56) References Cited

U.S. PATENT DOCUMENTS

| | | | | | |
|---|---|---|---|---|---|
| 800,184 | A | * | 9/1905 | Stola | 440/54 |
| 1,364,961 | A | * | 1/1921 | Thompson | 114/61.19 |
| 2,885,990 | A | * | 5/1959 | Hawthorne | 440/54 |
| 4,696,650 | A | * | 9/1987 | Haglund | 440/49 |
| 5,522,335 | A | * | 6/1996 | Veronesi et al. | 114/151 |
| 6,056,610 | A | * | 5/2000 | Fontanille | 440/54 |
| 6,067,697 | A | * | 5/2000 | Savikurki et al. | 29/426.1 |
| 6,371,696 | B1 | | 4/2002 | Eathorne | |
| 6,375,524 | B1 | * | 4/2002 | Commandeur et al. | 440/54 |
| 6,439,936 | B1 | * | 8/2002 | Dreith et al. | 440/54 |

(Continued)

FOREIGN PATENT DOCUMENTS

| | | | |
|---|---|---|---|
| NL | 1020217 | C1 | 5/2002 |
| NL | 1024826 | C1 | 5/2005 |
| WO | WO 2005/049420 | A1 | 6/2005 |

*Primary Examiner* — Lars A Olson
*Assistant Examiner* — Jovon Hayes
(74) *Attorney, Agent, or Firm* — Birch, Stewart, Kolasch & Birch, LLP

(57) ABSTRACT

A vessel with a retractable thruster assembly, the vessel comprising a hull, a vertical thruster well (20) within the hull, said thruster well having a bottom opening in a bottom plane of the hull. The vessel further comprises a retractable thruster assembly. This thruster assembly comprises: a thruster head (2) with a propeller (3), a casing structure (10) vertically guided in the thruster well, the casing structure having a lower end portion (**10*b*) to which the thruster head is mounted so as to extend below the casing structure, the casing structure including a watertight compartment (12**), an electric propeller drive motor being housed in said compartment. The thruster assembly is vertically displaceable between an operative extended position, in which the thruster head projects downward beyond the bottom plane of the hull, and a retracted position, in which the thruster as assembly is raised and the thruster head is received with the thruster well.

12 Claims, 6 Drawing Sheets

(56) References Cited

Figure 1:
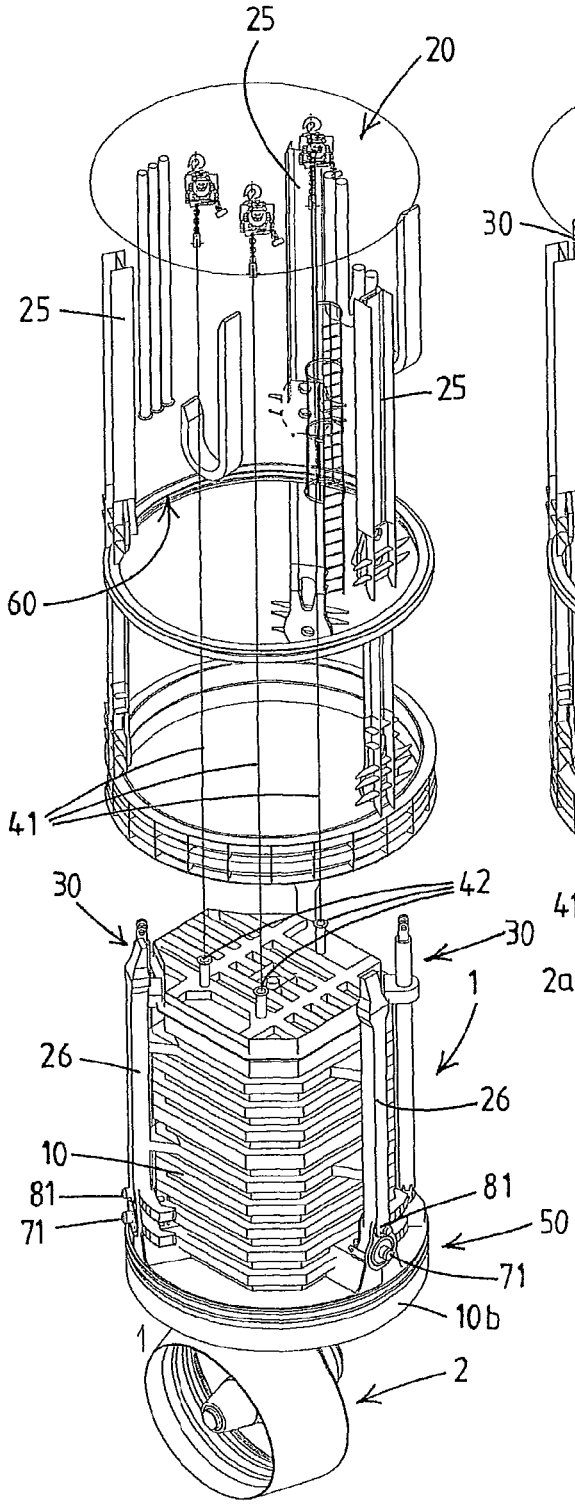

U.S. PATENT DOCUMENTS 6,458,004 B2 * 10/2002 Van Breems ..... 440/6
7,146,921 B2 * 12/2006 Fontanille et al. ..... 114/151
2001/0029133 A1 * 10/2001 Breems ..... 440/6
2007/0253821 A1 11/2007 Gabriel
2010/0175603 A1 * 7/2010 Jung ..... 114/40
2012/0231682 A1 * 9/2012 Roodenburg et al. ..... 440/54

* cited by examiner

VESSEL WITH A RETRACTABLE THRUSTER ASSEMBLY

The invention relates to a vessel with a retractable thruster assembly. The vessel has a hull with a vertical thruster well in the hull, the well having an opening in a bottom plane of the hull. The thruster assembly includes a thruster head with a propeller. The thruster assembly is vertically displaceable between an operative extended position, in which the thruster head projects downward beyond the bottom plane of the hull, and a retracted position, in which the thruster assembly is raised and the thruster head is received with the thruster well.

Nowadays many vessels are provided with one or more retractable thrusters assemblies for propulsion and/or dynamic positioning of the vessel. For instance drilling vessels, crane vessels, pipelaying vessels, etc. are provided with one or more retractable thruster assemblies.

A first aspect of the invention relates to a vessel with a vertical thruster well and a retractable thruster assembly. The assembly comprises:

a thruster head with a propeller, a casing structure vertically guided in the thruster well, the casing structure having a lower end portion to which the thruster head is mounted so as to extend below the casing structure, the casing structure including a compartment, preferably watertight, a propeller drive motor, preferably electric, being housed in said compartment, wherein the thruster assembly is vertically displaceable between an operative extended position, in which the thruster head projects downward beyond the bottom plane of the hull, and a retracted position, in which the thruster assembly is raised and the thruster head is received with the thruster well, the vessel further comprising a retraction device for vertical displacement of the thruster assembly between an operative extended position, in which the thruster head projects downward beyond the bottom plane of the hull, and a retracted position, in which the thruster assembly is raised and the thruster head is received with the thruster well, wherein an annular gap is present between the lower end of the casing structure and a surrounding lower portion of the thruster well that surrounds the lower end of the casing structure when the thruster assembly is in its extended position.

In U.S. Pat. No. 6,439,936 an annular sealing member is disposed at the lower axial end face of the thruster assembly, said sealing member being pressed onto the underlying coaming plate by the weight of the thruster assembly as well as the water pressure (see FIG. 12 of U.S. Pat. No. 6,439,936). In said prior art solution the entire thruster assembly can be raised to such an elevated level that this sealing member, as well as the entire thruster head, are raised above the water line and thus accessible for inspection and maintenance. As explained with reference to the first aspect of the invention, this prior art solution e.g. comes with the drawback of requiring a thruster well of great height that is open at its upper end. Also this prior art solution does not allow for the casing structure to be lowered out of the thruster well.

The first aspect of the invention aims to provide a sealing arrangement between the thruster well and the casing structure that is operational both in the extended and in the retracted position. This e.g. allows for a portion of the casing structure to be below waterline even in the retracted position, the well then being pumped dry to allow for access to said lower end and any equipment at said location.

In particular the first aspect of the invention aims to provide a sealing arrangement wherein all relevant operable, e.g. inflatable, sealing members are accessible for inspection and/or maintenance purposes with the vessel in floating condition.

The first aspect of the invention provides a vessel, wherein the lower portion of the thruster well that surrounds the lower portion of the casing structure when the thruster assembly is in its extended position is embodied as a surrounding lower seal face portion of the thruster well, e.g. as a cylindrical metal part, e.g. with bevelled upper and/or lower edges.

A first operable sealing device is provided at the lower end of the casing structure of the thruster assembly, said first sealing device comprising one or more operable circumferential sealing members extending around the lower end of the casing structure, said one or more sealing members being adapted to seal the annular gap by sealingly engaging the surrounding lower seal face portion of the thruster well when the thruster assembly is in its extended position, The lower end portion of the casing structure further includes a circumferential seal face below the one or more sealing members of the first sealing device.

A second operable sealing device is mounted in the thruster well, spaced a vertical distance above the lower seal face portion of the thruster well, said second sealing device comprising one or more circumferential operable sealing members extending along an inner circumference of the thruster well, said one or more sealing members being adapted to seal the annular gap with the casing structure by sealingly engaging the circumferential seal face portion of the lower end portion of the casing structure when the thruster assembly is in its retracted position.

With this solution, in its retracted position the thruster assembly is raised with its one or more operable sealing members of the first sealing device above the level of the second sealing device, thereby allowing access to the one or more operable sealing members of the first sealing device for inspection and/or maintenance, and so that with the thruster assembly in its extended position the one or more sealing members of the second sealing device are accessible for inspection and/or maintenance.

As is preferred the one or more sealing members of the first sealing device and preferably also of the second sealing device are expandable sealing members and the sealing device comprises an expansion arrangement that is selectively operable to cause expansion of expandable sealing members.

Most preferably the expandable sealing members are inflatable and include one or more internal chambers and the expansion arrangement comprises a source for an inflation fluid, e.g. compressed air.

In a preferred embodiment the thruster well extends to above the load waterline of the vessel, and the second sealing device is arranged below the load waterline of the vessel. A pump is provided to empty the thruster well above the second sealing device when employed with the thruster assembly in its retracted position. As explained this allows for the second sealing device to be mounted at a level below load waterline, and thus for a limited total height of the thruster well.

It is envisaged as a preferred approach that—when moving the thruster assembly from its extended to its retracted position—first the thruster well is flooded to the actual waterline level, preferably using a pump that pumps seawater into the well, e.g. a ballast pump of the vessel. Then as a later step the first sealing device is operated to disengage the one or more sealing members thereof from the surrounding lower seal face of the thruster well, e.g. by deflating the one or more sealing members, their resiliency resulting in a decreased diameter of the sealing members. Then the thruster assembly is brought into its retracted position. There after the second sealing device is operated to provide a sealing with the casing structure and the well is pumped dry above the level of the second sealing device. Now the first sealing device is accessible for maintenance and inspection.

The flooding of the well by means of a pump, or by means of a valved water inlet duct, prior to the disengaging of the first sealing device has the advantage that the flooding is controlled and no upwards force of the water is exerted on the first sealing device while it is being disengaged.

A second aspect of the invention relates to the issue of demounting a thruster assembly from the vessel, e.g. when repairs are needed. In particular the first aspect of the invention relates to "underwater demounting" with the vessel is floating condition, e.g. at sea, in contrast to demounting in de dry-dock.

A common approach to underwater demounting for a non-retractable thruster head is described in U.S. Pat. No. 4,696,650. Herein three lowering lines are passed through dedicated lowering line pipes in the hull of the vessel. These lines are attached to the thruster head and the weight of the thruster head is transferred to the lowering lines. Then the thruster head is detached from the hull of the vessel and from the drive motor that is installed in the hull of the vessel. The thruster head is then lowered to a position complete clear off the hull. Via a hand-over procedure the thruster head is then connected to a hoisting crane and lifted along a side of the vessel.

Complete different approach to the issue of the need to perform repairs is disclosed in U.S. Pat. No. 6,439,936. Here a retractable thruster assembly is disclosed including a thruster head and a casing structure housing an electric drive motor for the propeller. The thruster well has an opening at the bottom plane of the vessel as well as on the deck of the vessel, allowing to lift the entire thruster assembly upward out of the thruster well. As disclosed therein the well also has such a height that the assembly can be raised to a repair and inspection position, which is above the normal retracted position of the thruster assembly. In the extended position the thruster assembly rests on a horizontal annular seat plate.

Advantage of the solution proposed in U.S. Pat. No. 6,439,936 compared to the underwater demounting in U.S. Pat. No. 4,696,650 are e.g. a less complicated procedure and no need for divers. However a serious drawback of the solution in U.S. Pat. No. 6,439,936 is that clear deck space is needed above the thruster well.

The second aspect of the present invention aims to provide an improved vessel allowing for an underwater demounting approach.

According to the second aspect of the invention a vessel is proposed, wherein the vessel comprises an underwater demountable and retractable thruster assembly, wherein the thruster assembly comprises:

a thruster head with a propeller, a casing structure vertically guided in the thruster well, the casing structure having a lower end portion to which the thruster head is mounted with its top end so as to extend below the casing structure, the casing structure including a watertight compartment, a propeller drive motor, preferably an electric motor, being housed in said compartment, wherein the thruster assembly is vertically displaceable between an operative extended position, in which the thruster head projects downward beyond the bottom plane of the hull, and a retracted position, in which the thruster assembly is raised and the thruster head is received with the thruster well, and wherein the thruster assembly has negative buoyancy with its watertight compartment sealed, and wherein the vessel further includes a thruster assembly hoisting device adapted to lower the thruster assembly downwards fully out of the thruster well as well as lift the thruster assembly from a position fully outside of the hull upward into the thruster well.

The thruster assembly will thus be allowed to sink out of the thruster well with the electric motor being protected from the water as it is housed in the sealed watertight compartment. The thruster assembly could be lowered onto the seabed, e.g. in a harbour, possibly on a dedicated cradle, for later retrieval or be connected to a crane and lifted via a hand-over procedure, e.g. as in U.S. Pat. No. 4,696,650.

In the vessel, the upper end of the thruster well need not be open, thus allowing the thruster well to be closed at its upper end, e.g. as it is located below the crew accommodation of the vessel or working spaces of the vessel, or below a crane on the vessel, etc. Also, in comparison with the U.S. Pat. No. 6,439,936, the height of the thruster well can remain limited, as one can choose to limit the height such that the thruster assembly can not be lifted further upwards than the retracted position.

In the vessel, the propeller drive motor, preferably an electric motor, is removable along with the thruster head. The motor does not come into contact with the water as it is housed in the watertight compartment.

In a preferred embodiment a drive shaft section in the watertight compartment above the top end of the thruster head is removable, and a watertight closure is provided that is mountable to extend over the top end of the thruster head with the drive shaft section removed. The thruster assembly hoisting device is then adapted to engage directly on the thruster head. In this preferred embodiment the thruster head is detachable from the casing structure, thereby allowing to lower the thruster head fully below the casing structure as well as to lift the thruster head to the casing structure while said casing structure is positioned in the thruster well, preferably in the extended position thereof.

This preferred embodiment thus allows for an underwater demounting and mounting of the thruster head alone, e.g. when the propeller is damaged and/or repairs of the propeller shaft seals are needed. After having removed in any suitable manner a section of the drive shaft between the top end of the thruster head and the drive motor, and after having placed a suitable watertight closure over the top end of the thruster head, the thruster head can be detached and lowered.

In a preferred embodiment the casing structure of the thruster assembly includes multiple vertical pipes for receiving lines, e.g. steel cables or chains, that are connectable with their lower end to the thruster head. For instance, as is preferred, three such pipes are provided to obtain a three-point support, each pipe extending upwards through the casing structure.

Preferably the thruster head comprises fastening members generally aligned with the openings of the vertical pipes for fastening the lines to the thruster head. The fastening may involve the use of a diver. In another embodiment lengths of the lines are pre-installed in the pipes and fastened to the thruster assembly.

The vessel preferably includes one or more winch devices associated with these lines, the one or more winch devices and lines being operable to support the weight of the entire thruster assembly and to controllably lower and raise the entire assembly.

When the thruster head is disconnected from the casing structure, and the casing structure being retained in the thruster well, the lines serve to handle the thruster assembly. With the thruster head connected to casing structure, and the casing structure released from the thruster well, the lines serve to handle the entire assembly.

A third aspect of the invention relates to the issue of locking the thruster assembly with respect to the thruster well, in particular in the extended position of the thruster assembly. The vessel comprises a vertical thruster well within the hull, and a retractable thruster assembly. The thruster assembly comprises a thruster head with a propeller, and a casing structure vertically guided in the thruster well, the casing structure having a lower end portion to which the thruster head is mounted so as to extend below the casing structure, the casing structure including a compartment, preferably watertight, a propeller drive motor, preferably electric, being housed in said compartment.

The thruster assembly is vertically displaceable between an operative extended position, in which the thruster head projects downward beyond the bottom plane of the hull, and a retracted position, in which the thruster assembly is raised and the thruster head is received with the thruster well.

The vessel further comprising a retraction device for vertical displacement of the thruster assembly between an operative extended position, in which the thruster head projects downward beyond the bottom plane of the hull, and a retracted position, in which the thruster assembly is raised and the thruster head is received with the thruster well.

In U.S. Pat. No. 6,439,936 it is disclosed to provide the lower end of the casing structure with an operable locking device having three mobile locking pins. The pins are each mounted on a hydraulic cylinder, allowing to press each locking pin outwards into a receiving opening of the thruster well when the thruster assembly is in its extended position. The pins are designed to bring about a three point connection of the thruster assembly to the thruster well and to transfer to the hull the reaction forces produced by operation of the thruster in any horizontal direction. As can be seen in U.S. Pat. No. 6,439,936 the vertical position of the thruster assembly in extended position is determined by the coaming plate onto which the lower end of the assembly is resting.

The third aspect of the invention aims to provide an improvement over this known locking device.

The third aspect also aims to provide a solution that allows for the entire thruster assembly to be lowered out of the thruster well.

According to the third aspect of the invention the locking device is adapted to lock the thruster assembly with respect to the thruster well at least in its extended position, preferably the locking device being adapted to lock the thruster assembly in a horizontal plane with respect to the thruster well as well as in vertical direction.

In addition to the locking device the vessel also includes an operable positioning device having one or more mobile positioning members that are distinct from the one or more mobile locking members, said positioning device being adapted to bring, or at least assist in bringing, the thruster assembly in a pre-locking position with respect to the thruster well.

It is then envisaged to first operate the positioning device and bring the thruster assembly in its pre-locking position and then to operate the locking device and lock the thruster assembly with respect to the thruster well. This means that the assembly is positioned at a predetermined pre-locking position, e.g. both in vertical direction as in the horizontal plane, before the locking device is operated. This e.g. allows for the mobile locking members to be introduced in corresponding locking openings with relatively small play between them.

In a preferred embodiment it is envisaged that the positioning device is adapted to bring about a rotational positioning motion of the thruster assembly with respect to the thruster well. This is advantageous as it allows for ample play in the vertical guidance of the thruster assembly in the thruster well, e.g. between guide rails on the thruster well and rail followers on the casing structure.

In a preferred embodiment the locking device includes multiple, e.g. three, mobile locking members, e.g. locking pins, on the casing structure, e.g. at 120° spacing, the well being provided with corresponding locking pin receiving openings.

In a preferred embodiment the positioning device includes multiple, e.g. three mobile positioning members, e.g. positioning pins, on the casing structure, e.g. at 120° spacing, the well being provided with corresponding receiving members.

It is envisaged that a receiving member for a mobile positioning member can have a wide receiving space for said member at a top of said member, said receiving space narrowing in downward direction to the pre-locking position. Herein it is envisaged as a possibility that the casing structure is held somewhat above its extended position when the mobile positioning members are deployed into the receiving space, the casing structure then being lowered to the extended position and the receiving member then cooperating with the mobile positioning member to force the assembly to its pre-locking position.

The skilled person will appreciate that the aspects of the invention can be used in any possible combination in order to benefit from the effects of each aspect.

The present invention also pertains to a thruster installation for mounting in a vessel, including a thruster well and a thruster assembly.

It will be appreciated that in a preferred embodiment the thruster head is steerable, the thruster assembly including a steering device to rotate the thruster head about a vertical steering axis. Preferable the top end of the thruster head includes a bearing arrangement with a thrust bearing and rotary bearing absorbing the reaction forces of the thruster in operation.

Preferably, as is common, the thruster head comprises a circular shroud surrounding the propeller.

Preferably the watertight compartment of the casing structure comprises a lower chamber, wherein the removable shaft section is present as well as the watertight closure that is used after removal of said shaft section, and an upper chamber housing the motor, preferably electric motor.

It is envisaged that the propeller drive motor is a vertical shaft electric motor, preferably having a rating of at least 1000 kilowatts.

It is envisaged that the vessel includes a dynamic positioning system and that the thruster assembly is part of said dynamic positioning system.

It is envisaged that the vessel includes an accommodation structure, e.g. including crew quarters and/or a bridge, above the deck of the vessel, e.g. at the bow of the vessel, and that one or more thruster wells and thrusters are located below the accommodation structure.

Figure 2:
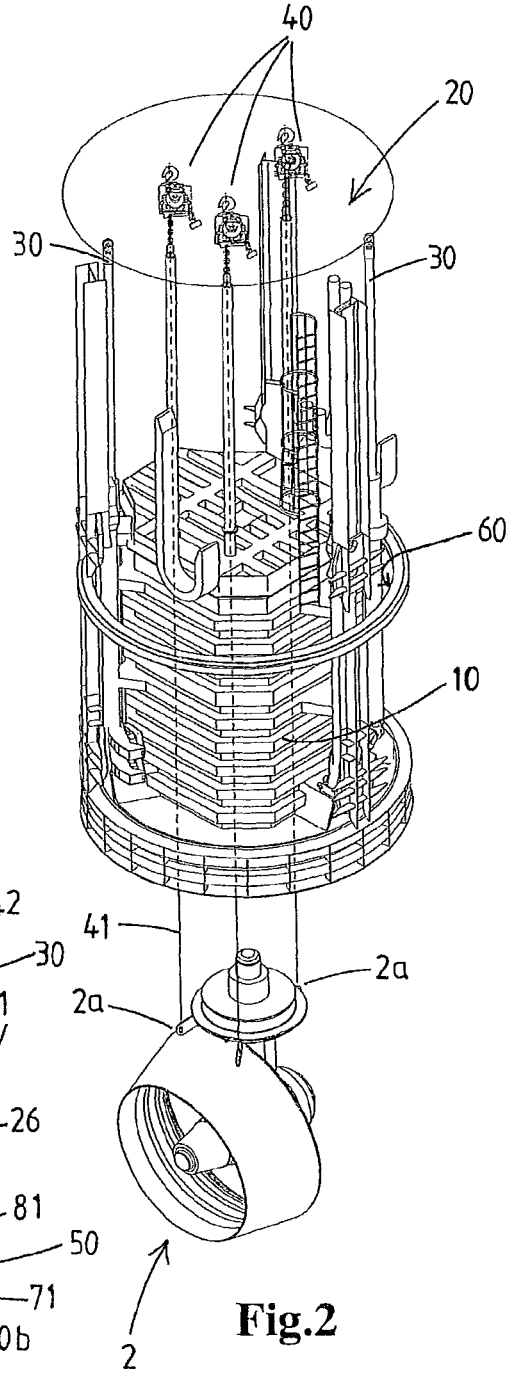
Figure 3:
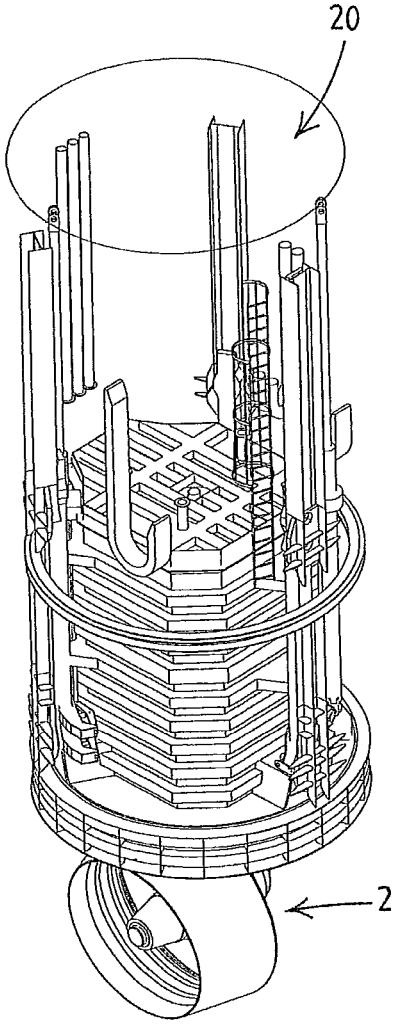
Figure 4:
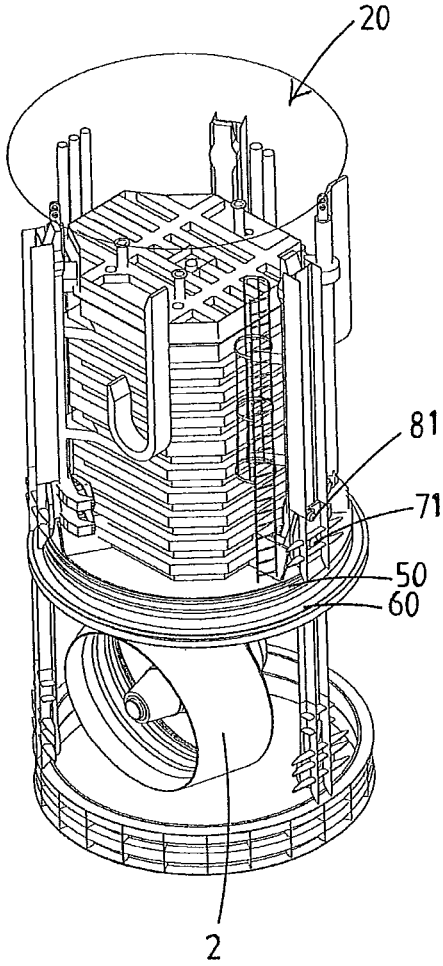
Figure 5:
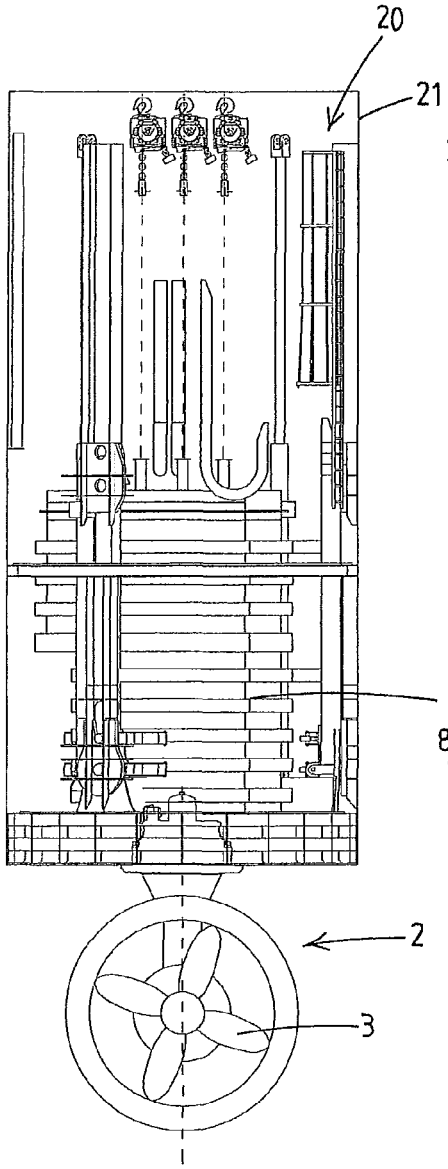
Figure 6:
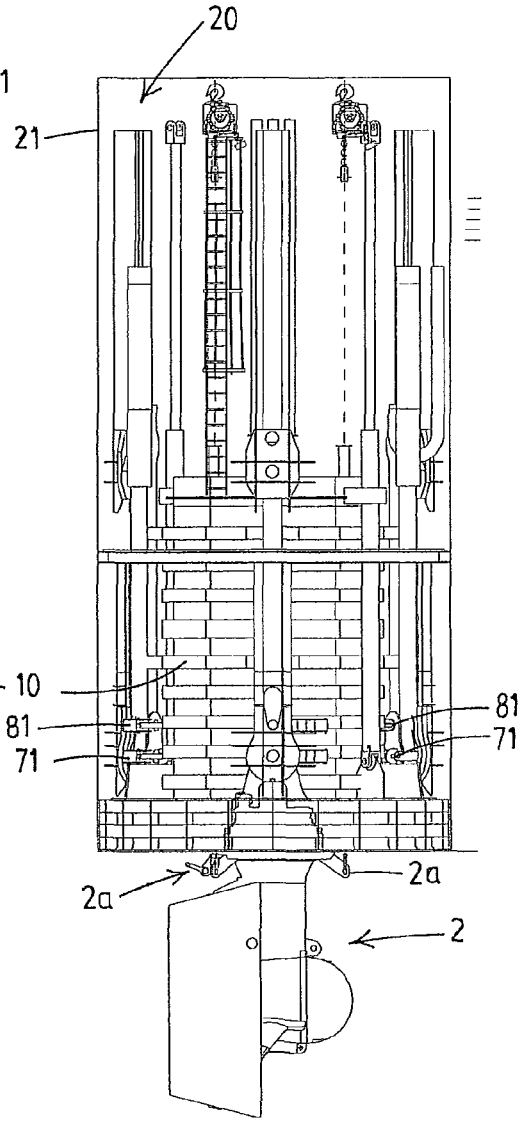
Figure 7:
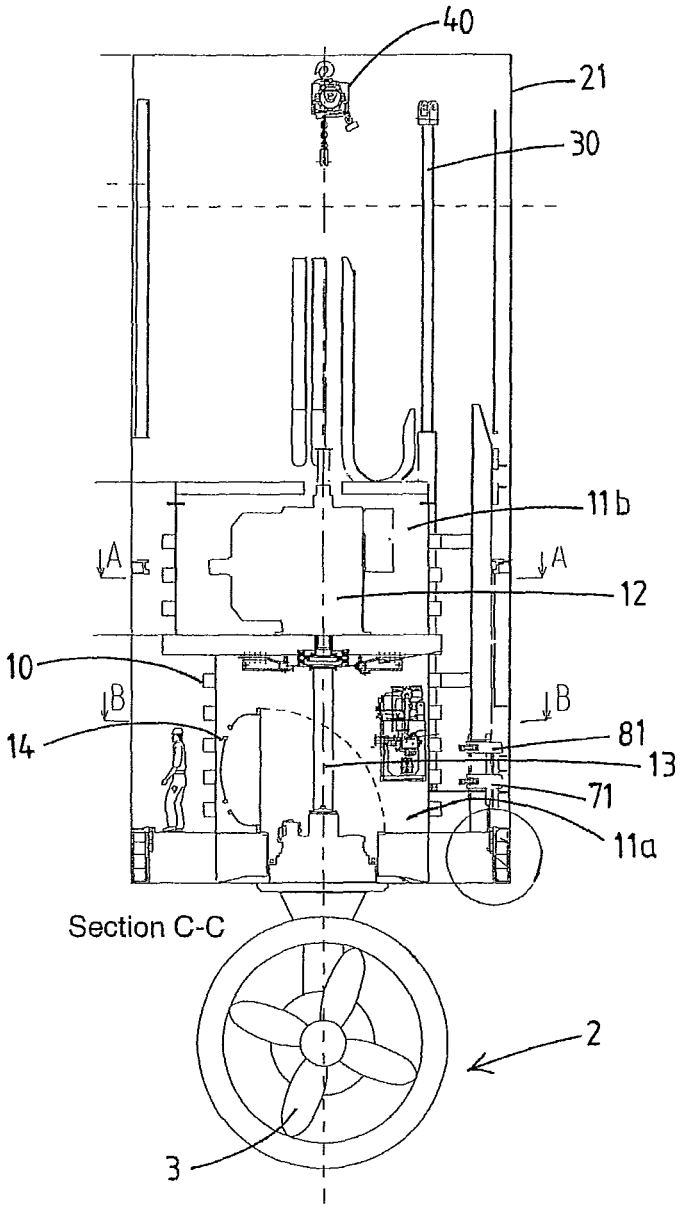
Figure 8:
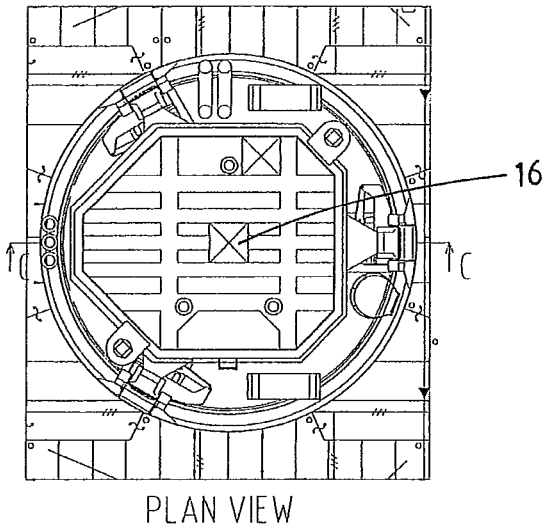
Figure 9:
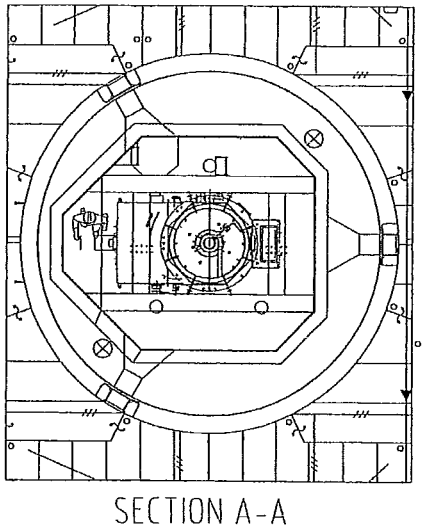
Figure 10:
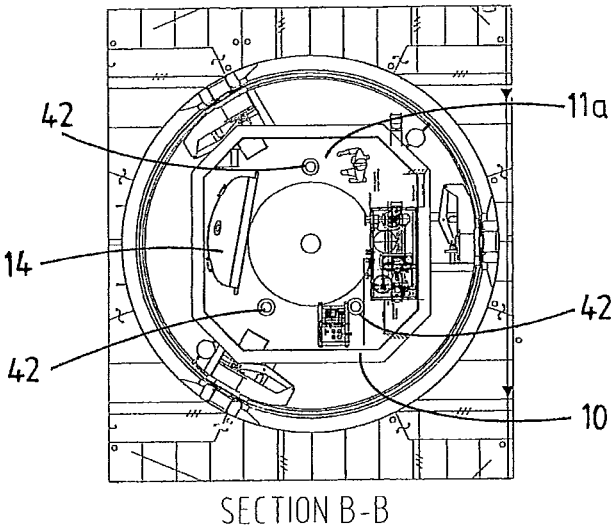
Figure 11:
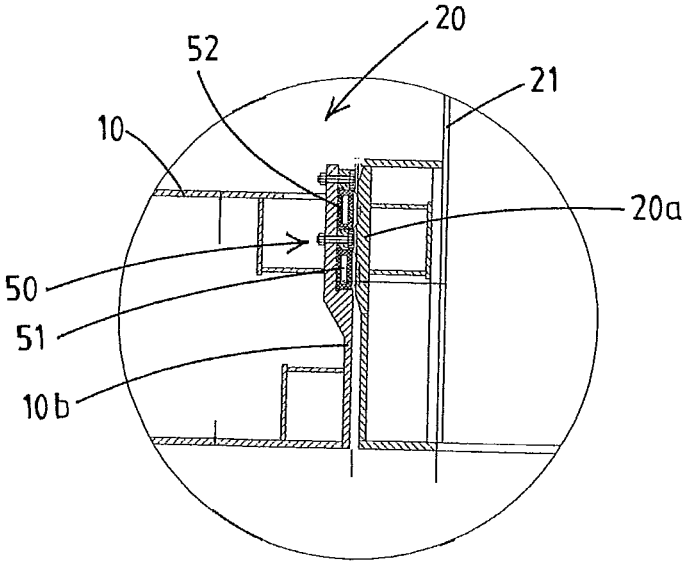

The aspects of the invention will now be disclosed in more detail with reference to a preferred embodiment of a thruster installation shown in the drawings. In the drawings:

FIG. 1 schematically shows the thruster installation with the entire thruster assembly suspended below the vessel;

FIG. 2 the installation of FIG. 1 with the thruster head suspended below the vessel;

FIG. 3 the installation of FIG. 1 in extended position of the thruster assembly;

FIG. 4 the installation of FIG. 1 in retracted position of the thruster assembly;

FIG. 5 the installation as in FIG. 3 in front view;

FIG. 6 the installation as in FIG. 3 in side view;

FIG. 7 the installation as in FIG. 3 in section C-C indicated in FIG. 8;

FIG. 8 a plan view of the installation as in FIG. 7;

FIG. 9 the installation along the section A-A in FIG. 7;

FIG. 10 the installation along the section B-B in FIG. 7;

FIG. 11 on enlarged scale the region of the first sealing device in the extended position of the thruster assembly.

The thruster installation of FIGS. 1-11 in its preferred embodiment according to the invention includes an underwater demountable and retractable thruster assembly 1.

Schematically shown is a vertical thruster well 20, the generally cylindrical side wall 21 thereof being left out most of the figures to facilitate understanding of the invention. The well has an opening in a bottom plane of the hull. As explained it is envisaged that the upper end of the well is closed, e.g. as further vessel structures are present above said well. As also explained it is envisaged that the well in the installation according to the invention can have limited height.

Not shown here is the vessel having a hull wherein the vertical thruster well is mounted. As explained all sorts of floating vessels are equipped with such thrusters.

In general the thruster assembly comprises:

a thruster head 2 with a propeller 3, and a casing structure 10 that is vertically guided in the thruster well.

The casing structure 10 has a lower end portion to which the thruster head 2 is mounted with its top end so as to extend below the casing structure 10, the casing structure including a watertight compartment 11, an electric propeller drive motor 12 being housed in said compartment 11.

The entire thruster assembly 1 is vertically displaceable between an operative extended position (see FIGS. 3,5,6,7, 11), in which the thruster head 2 projects downward beyond the bottom plane of the hull, and a retracted position (see FIG. 4), in which the thruster assembly 2 is raised and the thruster head is received with the thruster well, the lower end of the thruster head not protruding outside the hull of the vessel as is preferred.

Here the well is provided with guide rails 25 and the casing structure 10 is provided with mating guide members 26. As is preferred ample play is present in this guide structure to avoid any problems when raising and lowering the assembly.

As is preferred the lower end portion of the casing structure has a bottom plate, the bottom plate being coplanar with the bottom plane of the hull in extended operative position of the thruster assembly.

As preferred the entire thruster assembly 2, with the compartment 11 air-filled and closed, has negative buoyancy, so it tends to sink.

A retraction device for vertical displacement of the thruster assembly 1 between the operative extended position and the retracted position, here includes vertically arranged linear hydraulic cylinders 30, located along the side wall of the well as is preferred.

In addition to the dedicated retraction device, also provision is made here for a thruster assembly hoisting device adapted to lower the thruster assembly 1 downwards fully out of the thruster well as well as lift the thruster assembly from a position fully outside of the hull upward into the thruster well. In this example three chain winches 40 are depicted at the upper end of the well, each supporting a line, here a length of chain and cable 41. The cables 41 can be passed through dedicated vertical pipes 41 in the casing structure of the thruster assembly 1, here passing through the compartment 10. Each line 41 is connectable with its lower end to the thruster head 2. in this example, as is preferred, three such pipes 42 are provided to obtain a three-point support, each pipe extending upwards through the casing structure.

As is preferred the thruster head 2 comprises fastening members 2*a* generally aligned with the openings of the vertical pipes 42 for fastening the lines 41 to the thruster head. The fastening may involve the use of a diver.

The winches 40 and lines 41 are designed to support the weight of the entire thruster assembly 1 and to controllably lower and raise the entire assembly. As shown in FIG. 1 the entire assembly 1 can be lowered out of the well and to a distance below the bottom of the vessel. It will be understood that electrical lines and other connections between the thruster assembly and the vessel are disconnected, and that any opening in the watertight compartment, e.g. a manhole 16 for providing access at the top end, is closed.

In this preferred embodiment it is also envisaged that the thruster head 2 is detached from the casing structure, and only the thruster head 2 is lowered. This is shown in FIG. 2.

To understand this approach reference is made here to FIG. 7.

The drive shaft section 13 in the watertight compartment 11, here in lower chamber 11*a*, above the top end of the thruster head 2 is removable. A watertight closure 14 is provided that is mountable to extend over the top end of the thruster head 2 (here including the bearing assembly) once the drive shaft section 13 has been removed. As the thruster assembly hoisting device engages directly on the thruster head 2 the weight thereof can be transferred to said hoisting device. Now the thruster head is detached from the casing structure 10, e.g. by loosening bolts. This now allows to lower the thruster head 2 fully below the casing structure 10 (see FIG. 2) as well as lift the thruster head to the casing structure while said casing structure is positioned in the thruster well. As is preferred these operations are performed with the retractable thruster assembly in the extended position thereof.

Now the first aspect of the invention will be explained in more detail.

In FIG. 11, which is an enlargement of a detail in FIG. 7, it is shown that an annular gap is present between the lower end of the casing structure 10 and a surrounding lower seal face portion 20*a*, e.g. a cylindrical metal ring, of the thruster well that surrounds the lower end of the casing structure when the thruster assembly is in its extended position.

A first operable sealing device 50 is provided at the lower end of the casing structure of the thruster assembly, said first sealing device comprising one or more operable circumferential sealing members 51, 52 extending around the lower end of the casing structure. These sealing members 51, 52 are adapted to seal the annular gap by sealingly engaging the surrounding lower seal face portion 20*a* of the thruster well when the thruster assembly is in its extended position.

The lower end portion of the casing structure 10 further includes a circumferential seal face 10*b*, e.g. a cylindrical metal ring, below the sealing members 51, 52 of the first sealing device 50.

A second operable sealing device 60 is mounted in the thruster well, spaced a vertical distance above the lower seal face portion 20*a* of the thruster well. The second sealing device 60 comprises one or more circumferential operable sealing members (e.g. similar to the sealing members 51, 52) extending along an inner circumference of the thruster well. These one or more sealing members are adapted to seal the annular gap by sealingly engaging the circumferential seal face portion 10*b* of the lower end portion of the casing structure when the thruster assembly is in its retracted position, so that in its retracted position the thruster assembly is raised with its one or more sealing members 51, 52 of the first sealing device above the level of the second sealing device 60 (see FIG. 4), thereby allowing access to the one or more sealing members 51, 52 of the first sealing device for inspection and/or maintenance. Also with the thruster assembly in its extended position the one or more sealing members of the second sealing device 60 are accessible for inspection and/or maintenance.

As is preferred the one or more sealing members 51, 52 of the first sealing device and/or the second sealing device 60 are expandable sealing members and the sealing device comprises an expansion arrangement that is selectively operable to cause expansion of expandable sealing members. Most preferably the expandable sealing members 51, 52 are inflatable and include one or more internal chambers and wherein the expansion arrangement comprises a source for an inflation fluid, e.g. compressed air.

It is shown here that the thruster well extends to above the waterline of the vessel, and that the second sealing device 60 is arranged below the load waterline of the vessel. A pump is provided to empty the thruster well above the second sealing device 60 when employed with the thruster assembly in its retracted position (see FIG. 4).

It is proposed that—when moving the thruster assembly from its extended to its retracted position—first the thruster well is flooded to the actual waterline level, then the first sealing device 50 is operated to disengage the one or more sealing members from the surrounding lower seal face of the thruster well, and then the thruster assembly is brought into its retracted position.

A third aspect of the invention will now be discussed in more detail.

The thruster installation further includes an operable locking device 70 having one or more mobile locking members 71. The locking device is adapted to lock the thruster assembly 1 with respect to the thruster well. As is preferred the locking device provides for a locking of the thruster assembly in the horizontal plane, actually transmitting reaction forces to the hull of the vessel, at least in the lower region of the casing structure, as well as locking in the vertical direction.

In addition to the locking device 70, the installation also includes an operable positioning device 80 having one or more mobile positioning members 81 that are distinct from the one or more mobile locking members 71. The positioning device 80 is adapted to bring, or at least assist in bringing, the thruster assembly in a pre-locking position with respect to the thruster well.

It is envisaged to first operate the positioning device 80 and bring the thruster assembly in its pre-locking position and then to operate the locking device 70 and lock the thruster assembly with respect to the thruster well.

In this example, as is preferred, the locking device 70 includes a set of mobile locking members, here three pins 71 mobile arranged on the lower end of the casing structure above the sealing device 50. In the well, both at the lower end zone thereof as well as above the second sealing device, associated receiving members, here reinforced openings are provided into which the locking pins can be extended upon actuation, e.g. by a hydraulic ram actuator. The pins are adapted to exert a significant compressive force, basically centring the assembly 1 with respect to the well and absorbing reaction forces thereby avoiding damage to the sealing device 50.

Above each pin of the locking device, in this example, a mobile positioning pin 81 is shown that is arranged to be extended, e.g. by a hydraulic actuator, and the to be received in an associate receiving member, e.g. arranged in the lower end zone of the well.

The receiving member for a pin 81 can e.g. be a teardrop shaped opening, wider at the upper end than at the lower end. It is envisaged that the assembly 1 is first held somewhat above the extended position, then to extend the pins 81 into these teardrop shaped openings. Upon further lowering of the assembly, contact between the pins 81 and the teardrop shape opening will then if needed effect a rotation of the assembly 1 about its vertical axis, as well as a general position in vertical direction. This achieves an accurate alignment of the locking pins 71 with their associated openings, so that their introduction into those openings is smooth.

It will be appreciated that another downwards narrowing design of the receiving openings of the pins 81 will have a similar effect.

By providing separate positioning means any problems associated with misalignment in the locking device is avoided, which is advantageous as the locking device is embodied to exert significant forces, e.g. multiple tonnes of load per pin, so that misalignment may cause damage to relevant parts.

Also careful alignment is beneficial to the quality of the sealing obtained with sealing device 50.

It is envisaged that when sealing members 51, 52 are inflatable, and/or the sealing member(s) of device 60, an accumulator is present filled with inflation medium, e.g. compressed air.

It is envisaged that a constant monitoring of any inflatable sealing member 51, 52 is provided, e.g. monitoring inflation pressure.

The invention claimed is:

1. A vessel with a retractable thruster assembly, the vessel comprising a hull, a vertical thruster well within the hull, said thruster well having a bottom opening in a bottom plane of the hull, the vessel further comprising a retractable thruster assembly, wherein the thruster assembly comprises:

a thruster head with a propeller, a casing structure vertically guided in the thruster well, the casing structure having a lower end portion to which the thruster head is mounted such that the thruster head extends below the casing structure, the casing structure including a watertight compartment, a motor being housed in said compartment, wherein the thruster assembly is vertically displaceable between an extended position, in which the thruster head projects downward beyond the bottom plane of the hull, and a retracted position, in which the thruster assembly is raised and the thruster head is received within the thruster well, the vessel further comprising a retraction device for vertical displacement of the thruster assembly between said extended position and said retracted position, wherein an annular gap is present between the lower end portion of the casing structure and a surrounding lower seal face portion of the thruster well that surrounds the lower end portion of the casing structure when the thruster assembly is in said extended position, wherein a first sealing device is provided at the lower end portion of the casing structure of the thruster assembly, said first sealing device comprising one or more circumferential sealing members extending around the lower end portion of the casing structure, said one or more circumferential sealing members of said first sealing device being expandable circumferential sealing members, wherein the first sealing device comprises an expansion arrangement configured to cause expansion of the expandable circumferential sealing members of said first sealing device to seal the annular gap by sealingly engaging the surrounding lower seal face portion of the thruster well when the thruster assembly is in said extended position, wherein the lower end portion of the casing structure further includes a circumferential seal face below the one or more circumferential sealing members of the first sealing device, and wherein a second sealing device is mounted in the thruster well, spaced a vertical distance above the lower seal face portion of the thruster well, said second sealing device comprising one or more circumferential sealing members extending along an inner circumference of the thruster well, said one or more circumferential sealing members of said second sealing device being expandable circumferential sealing members, wherein the second sealing device comprises an expansion arrangement configured to cause expansion of the expandable circumferential sealing members of said second sealing device to seal the annular gap by sealingly engaging the circumferential seal face portion of the lower end portion of the casing structure when the thruster assembly is in said retracted position, so that in said retracted position the thruster assembly is raised with said one or more circumferential sealing members of the first sealing device above the level of the second sealing device, thereby allowing access to the one or more circumferential sealing members of the first sealing device for inspection and maintenance, and so that with the thruster assembly in said extended position the one or more circumferential sealing members of the second sealing device are accessible for inspection and-maintenance.

2. The vessel according to claim 1, wherein the expandable circumferential sealing members of the first and second sealing devices are inflatable and each include one or more internal chambers and wherein the expansion arrangement of each of the first and second sealing devices comprises a source for an inflation fluid.

3. The vessel according to claim 1, wherein the thruster well extends to above a load waterline of the vessel, and wherein the second sealing device is arranged below the load waterline of the vessel, and wherein a pump is provided to empty the thruster well above the second sealing device when employed with the thruster assembly in said retracted position.

4. A method for moving a thruster assembly from said extended position to said retracted position in a vessel according to claim 1, wherein when moving the thruster assembly from said extended position to said retracted position, first the thruster well is flooded to the actual waterline level, then the first sealing device is operated to disengage the one or more circumferential sealing members of the first sealing device from the surrounding lower seal face of the thruster well, and then the thruster assembly is brought into said retracted position.

5. A thruster installation to be mounted in a hull of a vessel comprising a vertical thruster well and a retractable thruster assembly, said thruster well having a bottom opening adapted to extend in a bottom plane of the hull, wherein the thruster assembly comprises:

a thruster head with a propeller, a casing structure vertically guided in the thruster well, the casing structure having a lower end portion to which the thruster head is mounted such that the thruster head extends below the casing structure, the casing structure including a watertight compartment, a motor being housed in said compartment, wherein the thruster assembly is vertically displaceable between an extended position, in which the thruster head projects downward beyond the bottom opening, and a retracted position, in which the thruster assembly is raised and the thruster head is received within the thruster well, the installation further comprising a retraction device for vertical displacement of the thruster assembly between said extended position and said retracted position, wherein an annular gap is present between the lower end portion of the casing structure and a surrounding lower seal face portion of the thruster well that surrounds the lower end portion of the casing structure when the thruster assembly is in said extended position, wherein a first sealing device is provided at the lower end portion of the casing structure of the thruster assembly, said first sealing device comprising one or more circumferential sealing members extending around the lower end portion of the casing structure, said one or more circumferential sealing members of said first sealing device being expandable circumferential sealing members, wherein the first sealing device comprises an expansion arrangement configured to cause expansion of the expandable circumferential sealing members of said first sealing device to seal the annular gap by sealingly engaging the surrounding lower seal face portion of the thruster well when the thruster assembly is in said extended position, wherein the lower end portion of the casing structure further includes a circumferential seal face below the one or more circumferential sealing members of the first sealing device, and wherein a second sealing device is mounted in the thruster well, spaced a vertical distance above the lower seal face portion of the thruster well, said second sealing device comprising one or more circumferential sealing members extending along an inner circumference of the thruster well, said one or more circumferential sealing members of said second sealing device being expandable circumferential sealing members, wherein the second sealing device comprises an expansion arrangement configured to cause expansion of the expandable circumferential sealing members of said second sealing device to seal the annular gap by sealingly engaging the circumferential seal face portion of the lower end portion of the casing structure when the thruster assembly is in said retracted position, so that in said retracted position the thruster assembly is raised with said one or more circumferential sealing members of the first sealing device above the level of the second sealing device, thereby allowing access to the one or more circumferential sealing members of the first sealing device for inspection and maintenance, and so that with the thruster assembly in said extended position the one or more circumferential sealing members of the second sealing device are accessible for inspection and-maintenance.

6. A vessel with an underwater demountable and retractable thruster assembly, the vessel comprising a hull, a vertical thruster well within the hull, said thruster well having a bottom opening in a bottom plane of the hull, the vessel further comprising an underwater demountable and retractable thruster assembly, wherein the thruster assembly comprises:

a thruster head with a propeller, the thruster head including a top end, a casing structure vertically guided in the thruster well, the casing structure having a lower end portion to which the thruster head is mounted with said top end such that the thruster head extends below the casing structure, the casing structure including a watertight compartment, a motor being housed in said compartment, wherein the thruster assembly is vertically displaceable between an extended position, in which the thruster head projects downward beyond the bottom plane of the hull, and a retracted position, in which the thruster assembly is raised and the thruster head is received within the thruster well, wherein the thruster assembly has negative buoyancy, and wherein the vessel further includes a thruster assembly hoisting device adapted to lower the thruster assembly downwards fully out of the thruster well as well as lift the thruster assembly from a position fully outside of the hull upward into the thruster well.

7. The vessel according to claim 6, wherein a drive shaft section in the watertight compartment above the top end of the thruster head is removable, and wherein a watertight closure is provided that is mountable to extend over the top end of the thruster head, wherein the thruster assembly hoisting device is adapted to engage directly on the thruster head, and wherein the thruster head is detachable from the casing structure, thereby allowing to lower the thruster head fully below the casing structure as well as lift the thruster head to the casing structure while said casing structure is positioned in the thruster well.

8. A vessel with a retractable thruster assembly, the vessel comprising a hull, a vertical thruster well within the hull, said thruster well having a bottom opening in a bottom plane of the hull, the vessel further comprising a retractable thruster assembly, wherein the thruster assembly comprises:

a thruster head with a propeller, a casing structure vertically guided in the thruster well, the casing structure having a lower end portion to which the thruster head is mounted such that the thruster head extends below the casing structure, the casing structure including a compartment, a motor being housed in said compartment, wherein the thruster assembly is vertically displaceable between an extended position, in which the thruster head projects downward beyond the bottom plane of the hull, and a retracted position, in which the thruster assembly is raised and the thruster head is received within the thruster well, the vessel further comprising a retraction device for vertical displacement of the thruster assembly between said extended position and said retracted position, wherein the vessel further includes a locking device having one or more mobile locking members, said locking device being adapted to lock the thruster assembly with respect to the thruster well at least in said extended position, at least in vertical direction, wherein the vessel further includes a positioning device having one or more mobile positioning members that are distinct from the one or more mobile locking members, said positioning device being adapted to bring, or at least assist in bringing, the thruster assembly in a pre-locking position with respect to the thruster well, wherein in the pre-locking position, the thruster assembly is capable of being locked with respect to the thruster well by the locking device, and wherein the vessel is adapted to first operate the positioning device and bring the thruster assembly in said pre-locking position and then to operate the locking device and lock the thruster assembly with respect to the thruster well.

9. The vessel according to claim 8, wherein the locking device comprises a set of mobile locking members and associated receiving members, the locking members and the associated receiving members being arranged on the casing structure and the well respectively, or vice versa, wherein the mobile locking members are movable between a disengaged position wherein they are free from the receiving members and the thruster assembly is movable vertically within the thruster well, and a locked position, wherein thruster assembly is locked within the thruster well.

10. The vessel according to claim 8, where the positioning device comprises a set of mobile positioning members and associated receiving members, the mobile positioning members and the associated receiving members being arranged on the casing structure and the well respectively, or vice versa, wherein the mobile positioning members are movable between a disengaged position wherein they are free from the receiving members and the thruster assembly is movable vertically within the thruster well, and an engaged position, wherein they mate with the receiving members.

11. The vessel according to claim 9, where the positioning device comprises a set of mobile positioning members and associated receiving members, the mobile positioning members and the associated receiving members being arranged on the casing structure and the well respectively, or vice versa, wherein the mobile positioning members are movable between a disengaged position wherein they are free from the receiving members and the thruster assembly is movable vertically within the thruster well, and an engaged position, wherein they mate with the receiving members.

12. A thruster installation to be mounted in a hull of a vessel comprising a vertical thruster well and a retractable thruster assembly, said thruster well having a bottom opening adapted to extend in a bottom plane of the hull, wherein the thruster assembly comprises:

a thruster head with a propeller, a casing structure vertically guided in the thruster well, the casing structure having a lower end portion to which the thruster head is mounted such that the thruster head extends below the casing structure, the casing structure including a compartment, a motor being housed in said compartment, wherein the thruster assembly is vertically displaceable between an extended position, in which the thruster head projects downward beyond the bottom opening, and a retracted position, in which the thruster assembly is raised and the thruster head is received within the thruster well, the installation further comprising a retraction device for vertical displacement of the thruster assembly between said extended position and said retracted position, wherein the installation further includes a locking device having one or more mobile locking members, said locking device being adapted to lock the thruster assembly with respect to the thruster well at least in said extended position, at least in vertical direction, wherein the installation further includes a positioning device having one or more mobile positioning members that are distinct from the one or more mobile locking members, said positioning device being adapted to bring, or at least assist in bringing, the thruster assembly in a pre-locking position with respect to the thruster well, wherein in the pre-locking position, the thruster assembly is capable of being locked with respect to the thruster well by the locking device, and wherein the installation is adapted to first operate the positioning device and bring the thruster assembly in said pre-locking position and then to operate the locking device and lock the thruster assembly with respect to the thruster well.

* * * * *